US007699716B2

(12) United States Patent
Burnett et al.

(10) Patent No.: US 7,699,716 B2
(45) Date of Patent: Apr. 20, 2010

(54) SET OF IRON CLUBS WITH CONSTANT GROUND ROLL

(75) Inventors: Michael Scott Burnett, Carlsbad, CA (US); Peter J. Gilbert, Carlsbad, CA (US); Charles E. Golden, Encinitas, CA (US); David A. Shear, Raleigh, NC (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/437,423

(22) Filed: May 7, 2009

(65) Prior Publication Data

US 2009/0215549 A1 Aug. 27, 2009

Related U.S. Application Data

(62) Division of application No. 11/424,271, filed on Jun. 15, 2006, now abandoned.

(51) Int. Cl.
*A63B 53/00* (2006.01)
*A63B 53/04* (2006.01)

(52) U.S. Cl. ..... 473/282; 473/290; 473/316; 473/324; 473/409

(58) Field of Classification Search ..... 473/282, 473/290–291, 316, 324, 409
See application file for complete search history.

(56) References Cited

U.S. PATENT DOCUMENTS

| | | | | |
|---|---|---|---|---|
| 4,026,561 | A * | 5/1977 | Baldorossi et al. | 473/256 |
| 4,531,742 | A | 7/1985 | Craycraft | |
| 4,645,207 | A * | 2/1987 | Teramoto et al. | 473/290 |
| 4,971,321 | A * | 11/1990 | Davis | 473/287 |
| 5,295,686 | A * | 3/1994 | Lundberg | 473/291 |
| 5,333,872 | A * | 8/1994 | Manning et al. | 473/291 |
| 5,885,170 | A | 3/1999 | Takeda | |
| 6,290,607 | B1 | 9/2001 | Gilbert et al. | |
| 6,482,104 | B1 | 11/2002 | Gilbert | |
| 6,729,970 | B2 * | 5/2004 | Horwood et al. | 473/289 |
| 6,830,519 | B2 | 12/2004 | Reed et al. | |
| 6,860,819 | B2 | 3/2005 | Gilbert | |

* cited by examiner

*Primary Examiner*—Stephen L. Blau
(74) *Attorney, Agent, or Firm*—Michael J. Mancuso

(57) ABSTRACT

A set of iron clubs where each club in the set has the same or substantially the same ground roll. The set is produced by adjusting at least two club design characteristics of the clubs based upon measured or assumed player swing data. The design characteristics of the clubs include club length, static clubhead loft, location of the center of gravity, shaft flexibility, and groove volume. Preferably, club length and static clubhead loft are adjusted for coarse adjustments, while the other characteristics are used to fine-tune the design.

20 Claims, 7 Drawing Sheets

SET OF IRON CLUBS WITH CONSTANT GROUND ROLL

CROSS-REFERENCE TO RELATED APPLICATIONS

This application is a divisional of U.S. patent application Ser. No. 11/424,271, filed Jun. 15, 2006, now abandoned the disclosure of which is incorporated by reference herein in its entirety.

BACKGROUND

The invention relates generally to a set of iron-type golf clubs. In particular, the invention relates to a set of irons with substantially constant ground roll.

In a set of irons, various design characteristics are varied from one club to the next. For example, individual iron club heads in a set typically increase progressively in face surface area and weight as the clubs progress from the long irons to the short irons and wedges. The shaft length shortens as the clubs progress from the long irons to the wedges, and the loft angle typically increases through the same progression. These design variables and others can be modified so that a particular club, for example a 3-iron, produces certain flight characteristics. Specifically, the clubs are designed to produce specific launch angles and to impart a certain amount of backspin to the ball, when the ball is struck correctly, i.e., with an anticipated speed and at the nominal hitting point, typically a point on the hitting face about 18 mm or less above the ground when the club is in the address position. When struck in the appropriate manner, the combination of ball speed, launch angle and backspin produces an anticipated flight path, with the ball achieving a specific height at the maximum point of the parabolic arc of the path and a specific carry distance.

In traditional iron sets, flight path height (distance above ground) and carry distance are generally the performance parameters which a golf club is designed to achieve. However, another parameter, ground roll of the ball, is relatively neglected in the overall design of the club, with ground roll being dependent upon the design characteristics selected to achieve a specific flight path. As such, traditional iron sets result in longer shots having the ball roll more on a green than do the shorter shots. This creates difficulty in hitting long shots which will stop on a green. Also, some short shots can roll backwards on the green. As a result, precisely controlling the total distance achieved by a shot may prove difficult if the player cannot accurately account for ground roll distance. A shot hit with a club from an iron set would be easier to control, i.e., the distance attained for a shot from each iron would be more predictable, if each would roll a prescribed distance.

Therefore, a need exists for a set of iron clubs having predictable ground roll. Such a set of clubs may have the same ground roll for each club in the set.

SUMMARY OF THE INVENTION

An aspect of the invention is directed toward a set of iron-type clubs comprising at least two clubs, wherein a ground roll distance produced by each of the at least two clubs is substantially the same.

Another aspect of the invention is directed toward a method for producing a set of golf clubs with constant ground roll comprising the steps of (i) selecting a target ground roll, (ii) selecting a club, (iii) obtaining a ground roll performance curve for the club and at least one other performance curve using the club, and (iv) adjusting at least two design characteristics of the club to achieve the target ground roll while maintaining the at least one other performance curve.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
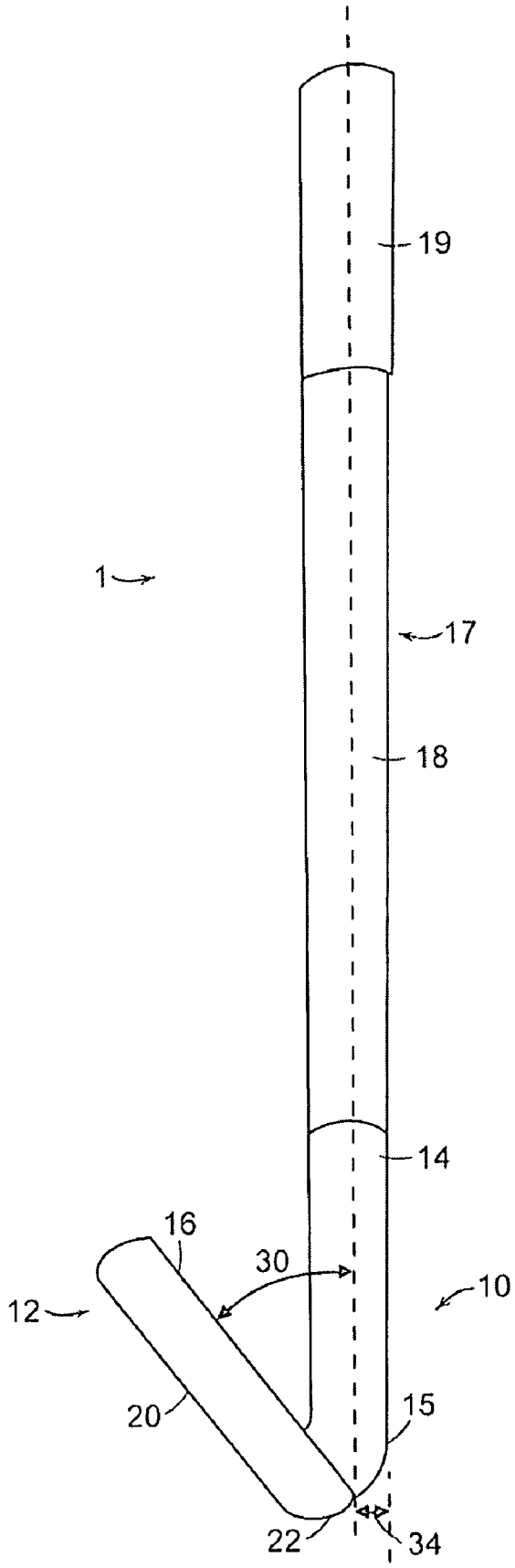
FIG. 1 is a schematic view of a standard iron club.

As illustrated in the accompanying drawings and discussed in detail below, the present invention is directed to a set of iron-type golf clubs, wherein the clubs have substantially the same ground roll distance throughout the set. Each club 1 in a set includes a club head 10 attached to a tubular portion 18 of a shaft 17 in any manner known in the art, such as with an adhesive, welding, or screwing threaded portions of club head 10 to a correspondingly threaded portion of tubular portion 18. The length of club 1 is determined by measuring from a grip or handle portion 19 of shaft 17 to a sole 22.

Club head 10 includes, generally, a body 12 and hosel 14. Body 12 includes a striking or hitting face 16 and a rear face 20. Body 12 is attached to hosel 14 at an angle, such that a loft angle 30 is defined between a hosel center line 18 and hitting face 16. Further, the relative configuration of body 12 and hosel 14 results in an offset 34 between the leading edge of the base of sole 22 at the base of hitting face 16 and the forward-most point 15 of hosel 14.

In typical sets of golf clubs, the area of hitting face 16, the heel-to-toe length of body 12, loft angle 30, and offset 34 vary from club to club within the set. For example, long irons, such as a 2- or 3-iron using conventional numbering, typically include relatively long shafts 17, relatively small areas for hitting face 16, and relatively low loft angles 30. Similarly, short irons, such as an 8- or 9-iron using conventional numbering, typically include relatively short shafts 17, relatively large areas for hitting face 16, and relatively high loft angles 30. In one embodiment of the present invention, these parameters are particularly chosen to maximize the performance of each club 1 for its intended use in terms of carry distance.

The total distance achieved by a ball struck by a club is the carry distance plus the distance the ball rolls upon landing, also referred to as "ground roll". Ground roll is generally influenced by initial conditions of the ball upon impact, such as launch speed, launch angle and back spin. Many factors influence the ground roll distance, including club design characteristics and player swing characteristics. In a set of clubs according to the present invention, the design parameters of the clubs in the set and/or the player swing characteristics are matched and selected not only to maximize the performance of each club for its intended use, for example as a wedge, but also to achieve a predictable level of ground roll of a ball struck by any club in the set, such as constant or substantially constant ground roll.

In accordance with an aspect of the present invention, the inventive iron golf clubs are designed to have substantially the same carry distance as conventional iron golf clubs. Each inventive iron golf club is designed to hit golf balls a prescribed distance in the air, and to stop on the green or fairway in a predictable manner. Expected ground roll distances for conventional irons ranges from about 6 yards for a 3-iron, 2 yards for a 6-iron and 0 yards (or less) for a 9-iron. Hence, it is difficult for a player to make the ball stop on the green with a 3-iron. The present invention includes a method for creating a set of iron clubs that has substantially the same ground roll for each club, while maintaining the same carry distance as the conventional clubs. Preferably, each club should have the same ground roll distance±1 yard.

Using actual golf ball launch data, the carry distance and ground roll are calculated using a mathematical model. First, a targeted ground roll is selected, i.e., 2 yards±1 yard. Next, adjustments are made to adjust the ground roll to reach the target roll. For example, if the data suggest that the landing roll for a particular club is longer than the target ground roll, then adjustments are made to reduce the roll. Adjustments include, but are not limited to, the following factors:

i. increasing/decreasing shaft length to adjust clubhead speed and initial ball speed;
ii. increasing/decreasing static loft angle to adjust trajectory and backspin;
iii. flexing characteristics of the shaft to adjust clubhead speed and initial ball speed;
iv. location of the center of gravity (e.g.) of the clubhead, including lowering the e.g. and/or moving the e.g. aft of the hitting face, to adjust trajectory of the ball; and
v. varying groove geometry to adjust the amount of ball spin A high launch/high spin combination makes the ball fly higher and reduces carry and roll distances. In one example, higher trajectory is coupled with longer shaft length (or shaft flex) to increase ball speed to make up for the loss of carry distance, but to keep the ground roll unchanged. Hence, in this example, after the adjustments the club maintains its expected carry distance while the ground roll distance has been adjusted to meet the targeted roll distance. This method is repeated for each club in the set to achieve the same targeted roll distance for all the clubs.

In accordance with one aspect of the present invention, at least two of the above five club factors are used to reach the targeted ground roll. It is noted that other factors may be used for this purpose.

The properties of the golf balls may also affect the targeted ground roll. For instance, the ball's compression, total hardness, cover material, and dimple pattern, among other factors, can affect both the carry distance and roll distance. The ball launch data includes multiple types of golf balls. Hence, the mathematical model is applicable to all golf balls, and the inventors expect that when the inventive iron golf clubs are used with a particular ball, the targeted ground roll distance remains the same throughout the set. However, the targeted ground roll may be different for different balls. For example, a higher performance golf ball such as the Titleist Pro-V1® or Pro-V1x™ would produce one targeted ground roll distance for the inventive set, while another ball would produce another targeted ground roll distance for the inventive set.

Discussed further below is an understanding of the players' swing characteristics, such as clubhead speed, angle of attack, loft at impact and nominal impact position. One of these player swing characteristics that impacts ground roll is the angle of attack, i.e., the angle between the path on which the clubhead strikes the ball and the horizontal ground plane. A typical forward swing for a golfer follows an arc, starting with a downswing, traveling through a fairly level portion at the bottom of the downswing before heading into the upswing part of the swing. Typically, the angle of attack for irons in generally downward, i.e., the ball is struck in the downswing portion of the swing arc. As the angle of attack becomes more level, the launch angle increases and the backspin decreases. The nominal impact location also affects the flight path. An ideal nominal impact location, the striking point on the hitting face of a club, is about 18 mm or less measured from ground when the club is in the address position. In the absence of ground contact, "thin" hits, hits lower than the nominal striking point, decrease the launch angle of a ball, and "fat" hits, hits higher than the nominal striking point, increase the launch angle of a ball.

In one embodiment of the present invention, club design characteristics are manipulated based upon assumed or measured player swing characteristics to achieve constant ground roll through the set. In other words, clubs of the set are designed so that a ball struck by any club in the set rolls the same distance, regardless of which club in the set is used to strike the ball. To achieve this effect, in one embodiment a set is designed so that each club, for example, a 3-iron, has the same or nearly the same flight trajectory as its conventional counterpart while ground roll remains constant. In a first embodiment, the club design parameters are chosen based upon a typical PGA Tour player's swing, where the model for the characteristics of the swing is derived from empirical data collected from a number of actual PGA Tour players. In another embodiment, a custom set may be developed by collecting data from an individual player and adjusting the club design parameters to match the swing characteristics of that specific player in order to achieve constant roll through the set. An individual's custom launch measurements can be obtained easily during a standard fitting session using a launch monitor system, such as the Titleist performance monitor (TPM).

Figure 2:
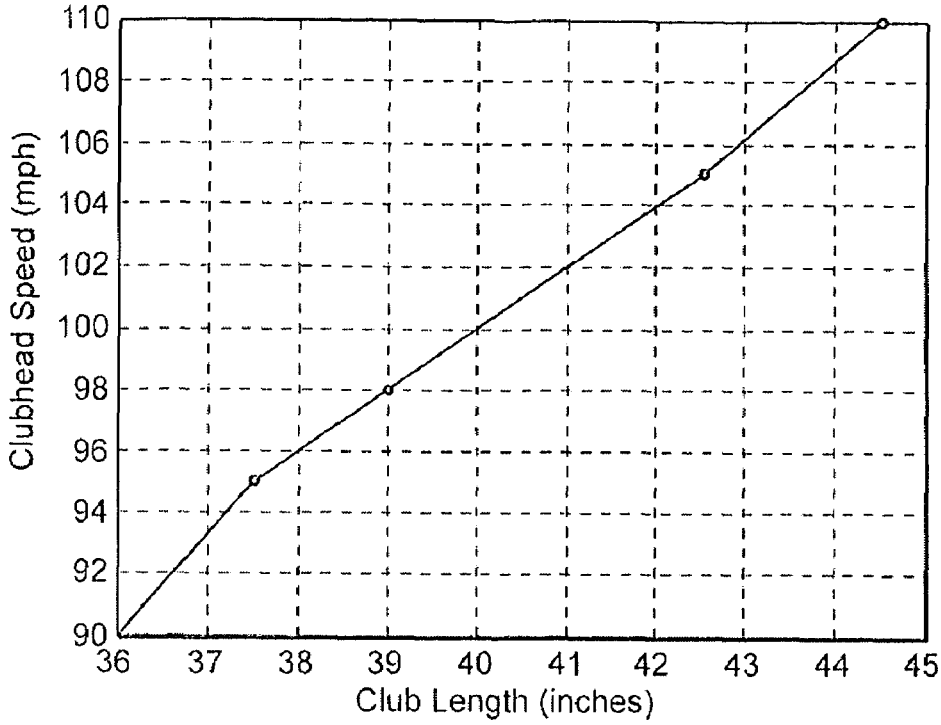
FIG. 2 is a graph showing the variation in clubhead speed versus club length for a typical PGA Tour player.

As discussed above, one club design characteristic that may be manipulated to influence ground roll is the clubhead speed. A player will swing a club with a certain amount of strength and skill to achieve a player-dependent swing speed. While swing speeds may vary widely among the general population, swing speed for PGA Tour players lends to be consistent and will fall within a relatively narrow range for a given club. For instance, it is uncommon for a PGA Tour player to swing a 3-iron outside of the 95 mph to 105 mph range, whereas a non-professional could easily fall well below the 100 mph mark. It is known in the art that clubhead speed also varies with club length given a certain swing speed, so the clubhead speed may be manipulated to control ground roll by altering the club length. FIG. 2 shows graphically how the clubhead speed of a club swung by an average PGA Tour player varies with club length for a conventional set of irons. The average clubhead speed variation with club length, as determined from the data shown in the graph of FIG. 2, is about a 2.35 mph increase in clubhead speed per 1 inch increase in club length. The corresponding increases in ball speed per 1 inch increase in club length for 3-, 6-, and 9-irons are shown below in Table 1.

TABLE 1

| Increase in Ball Speed Given a 1-inch Increase in Club Length | |
|---|---|
| Club Number | Increase in Ball Speed (mph) |
| 3 | 3.17 |
| 6 | 3.03 |
| 9 | 2.80 |

As clubhead speed increases, the initial velocity of the ball upon impact is also increased. As such, the ball will tend to have a greater carry distance and greater ground roll with increased clubhead speed, as is shown and discussed in greater detail below in the Example.

As the clubhead speed increases, so does the backspin imparted to the ball. Backspin, the backward rotation of the golf ball in flight along its horizontal axis, is imparted to the ball by the grooves formed in the hitting face of a club and friction between the ball and the striking face. When struck, the ball compresses into and slides along the hitting face, encountering the grooves. A tangential force is imparted to the ball which causes the backward rotation of the ball. As is well known in the art, backspin produces aerodynamic lift for greater carry distances. Also, backspin influences ground roll by slowing, stopping or even reversing the direction in which the ball is traveling when the ball hits the ground. In other words, ground roll is shorter or even backwards with greater backspin. Backspin generally increases with clubhead speed. Table 2 shows the increase in backspin for a 1 mph increase in clubhead speed for selected clubs from a set of muscle-back clubs, assuming a PGA Tour player swing hitting a Titleist® ProV1x™ ball.

TABLE 2

| Increase in Backspin of a 1 mph Increase in Clubhead Speed | |
|---|---|
| Club | Increase in Backspin (revolutions per minute) |
| 3-iron | +40 rpm |
| 6-iron | +58 rpm |
| 9-iron | +88 rpm |

Backspin also generally increases with static clubhead loft, i.e., the loft angle (element 30 in FIG. 1) of the club as measured when the club is in the address position. As loft angle increases, backspin increases. Static loft also impacts initial ballspeed, which decreases, with increasing static clubhead loft. Therefore, as the static loft increases, the ground roll decreases through a combination of lower ballspeed and increased backspin, as discussed above. Launch angle also affects ground roll, as ground roll generally decreases with increased launch angle. Table 3 shows the changes in ballspeed, backspin and launch angle for a 1 degree increase in static loft for selected clubs from a set of muscle-back clubs, assuming a PGA Tour player swing hitting a Titleist® ProV1x™ ball.

TABLE 3

| Per Degree Change in Ballspeed, Backspin and Launch Angle Increase in Static Loft | | | |
|---|---|---|---|
| Club | Change in Ballspeed (miles per hour) | Change in Backspin (revolutions per minute) | Change in Launch Angle (degrees) |
| 3-iron | −0.83 mph | +251 rpm | +0.71° |
| 6-iron | −1.15 mph | +242.8 rpm | +0.67° |
| 9-iron | −1.16 mph | +191.8 rpm | +0.63° |

Additional design characteristics which impact carry distance and ground roll include those design characteristics which impact launch angle. For example, the position of the center of gravity of the club influences launch angle, where a center of gravity closer to the sole of the clubhead increases the initial launch angle. Additionally, increased flexibility of the shaft also increases the initial launch angle. Further, the geometry of the grooves impacts backspin, with larger-volume and sharper radius grooves imparting greater backspin.

For the purposes of designing a set of constant ground roll clubs according to the present invention, the design of a conventional set of clubs with the desired flight path characteristics may be provided as a basic starting point. Alternatively, a set of clubs may be independently designed to obtain a set of clubs with the desired flight path characteristics. For the purposes of simplicity in the discussion, the set used as the basic starting point is referred to as "the conventional set" even if the set is specifically designed. Any two or more of the above-discussed parameters may be manipulated or slightly varied in order to substantially maintain the flight path characteristics of the conventional set, in particular the carry distances and/or the difference in carry distance from one club to the next in the set, while obtaining the desired constant or substantially constant ground roll. Preferably, club length and loft angle are the parameters which are varied from the conventional set, although any combination of parameters may be adjusted. Club length and loft angle are preferred in part because relatively minor changes in these parameters have a greater impact on carry distance and ground roll than do the other parameters discussed herein. In other words, club length and loft angle can be used for coarse corrections to carry distance and ground roll, while parameters such as shaft flexibility, groove volume, and center of gravity locations can be used to fine-tune carry distance and ground roll.

In one example, a set of constant ground roll clubs according to the present invention were predicated off of the design of a conventional set of iron clubs, the Titleist® 670. In other words, the flight path characteristics of the conventional set were chosen as desirable flight path characteristics. In order to achieve the same or similar characteristics, the conventional set's general overall design was maintained, while each club's length and loft angle were manipulated to produce the desired ground roll. In this example, it is desired to have all clubs roll to within one yard of the ground roll achieved by the conventional set 6-iron, although one of skill in the art will recognize that any ground roll may be selected as the target ground roll. In other words, if the 6-iron of the conventional set has a ground roll of 2 yards, the inventive set iron should have a ground roll between about 1 yard to about 3 yards. The conventional set is a muscle-back type iron made from forged steel. The conventional set 3-iron, 6-iron and 9-irons all have similar centers of gravity, both as measured from the ground when the club head is in the address position and as measured from a point on the hitting face about 15 mm above the ground when the club is in an address position.

Figure 3:
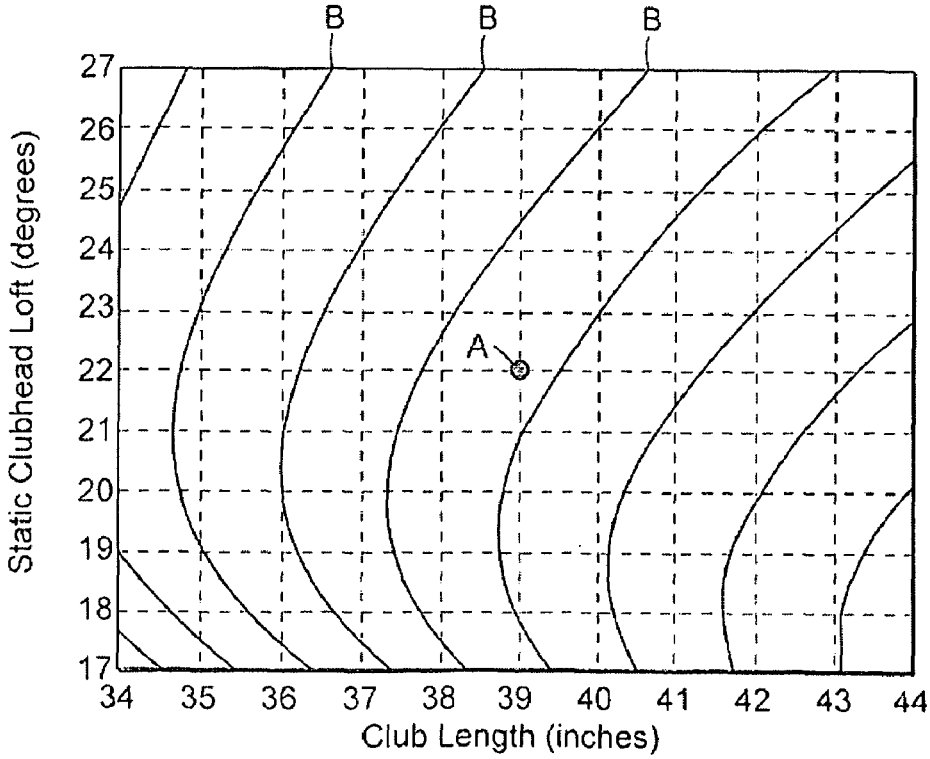
FIG. 3 is a graph showing the variation in carry distance versus club length and static club loft for 3-irons.

As discussed above, it is preferred that the clubs of the conventional set are adjusted by slightly varying club length and static clubhead loft in order to obtain the inventive constant roll set. FIG. 3 shows how carry distance is affected by static clubhead loft and club length. Point A on FIG. 3 indicates the distance traveled by a 3-iron of the conventional set, which has a static clubhead loft of 22° and a club length of 39 inches. Isobars B show carry distance performance curves in 10-yard increments, with carry distance increasing generally as club length increases. As shown, increasing only the club length of the 3-iron of the conventional set by one inch (to 40 inches) increases the carry distance by about 5 yards, and decreasing only the club length of the 3-iron of the conventional set by one inch (to 38 inches) decreases the carry distance by about 5 yards. Similarly, increasing only the static clubhead loft by one degree (to 23 degrees) decreases the carry distance by about 4 yards, and decreasing only the static clubhead loft by one degree (to 21 degrees) increases the carry distance by about 3 yards. Therefore, manipulating both parameters results in relatively large changes in carry distance. For example, by increasing the club length of the 3-iron of the conventional set by one inch (to 40 inches) and decreasing the static clubhead loft by one degree (to 21 degrees), a carry distance increase of about 10 yards can be achieved. Similarly, by decreasing the club length of the 3-iron of the conventional set by one inch (to 38 inches) and increasing the static clubhead loft by one degree (to 23 degrees), a carry distance decrease of about 9 yards can be achieved.

Figure 4:
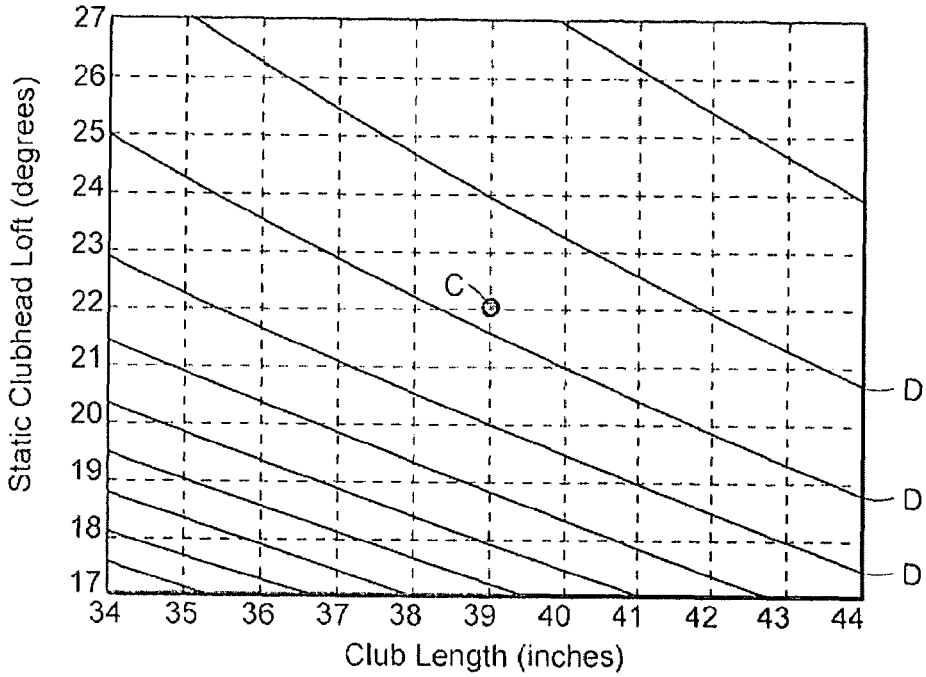
FIG. 4 is a graph showing the variation in ground roll versus club length and static club loft for 3-irons.

FIG. 4 shows how ground roll is affected by static clubhead loft and club length. Point C on FIG. 4 indicates the ground roll of a 3-iron of the conventional set. Isobars D show ground roll performance curves in 2-yard increments, with ground roll increasing generally as static clubhead loft decreases. As shown, increasing only the club length of the 3-iron of the conventional set by one inch (to 40 inches) decreases the ground roll by about ½ yard, while decreasing only the club length of the 3-iron of the conventional set by one inch (to 38 inches) increases the ground roll by about ½ yard. Further, increasing only the static club loft by one degree (to 23 degrees) increases the ground roll by about one yard, while decreasing the static club loft by one degree (to 21 degrees) decreases the ground roll by about one yard. As such, manipulating both parameters results in relatively large changes in ground roll. For example, by increasing the club length of the 3-iron of the conventional set by one inch (to 40 inches) and increasing the static clubhead loft by one degree (to 23 degrees), a ground roll decrease of about 1.5 yards can be achieved. Similarly, by decreasing the club length of the 3-iron of the conventional set by one inch (to 38 inches) and decreasing the static clubhead loft by one degree (to 21 degrees), a ground roll increase of about 1.5 yards can be achieved.

Figure 5:
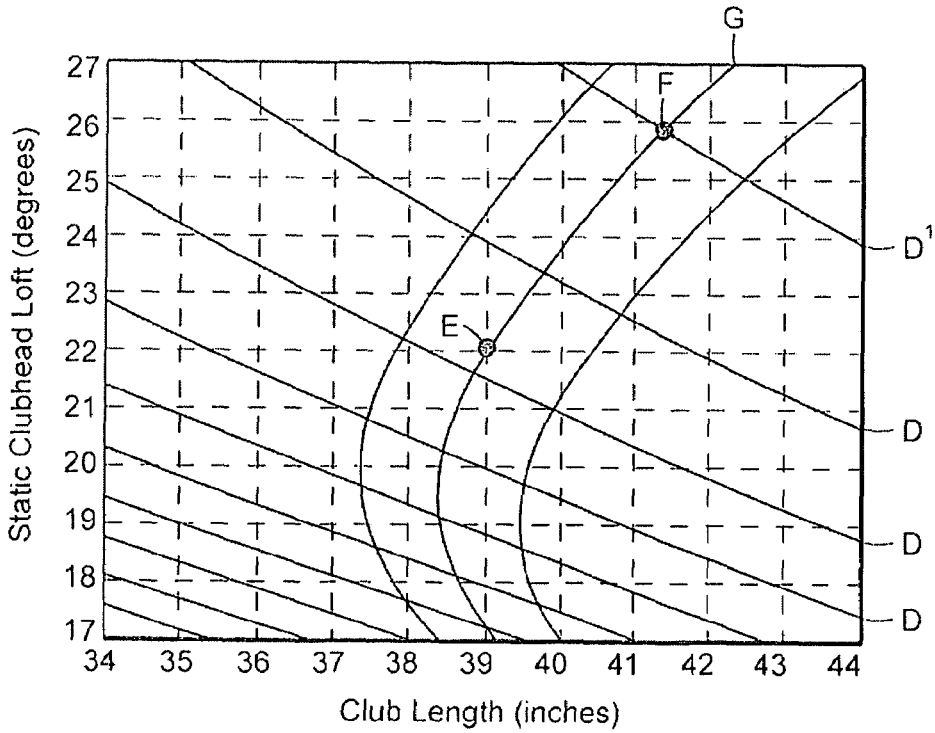
FIG. 5 is a graph superimposing the graph of FIG. 4 onto the graph of FIG. 3.

FIG. 5 shows how simultaneous changes in static clubhead loft and club length affect both ground roll and carry distance, assuming an average PGA Tour player swing, by overlaying a portion of the graph of FIG. 3 onto the graph of FIG. 4. Isobars D show ground roll differentials of 2 yards, with Isobar D' showing the target ground roll. Isobar G shows the carry distance of the 3-iron of the conventional set. Point E on FIG. 5 indicates the carry distance and ground roll of the 3-iron of the conventional set. By following Isobar G to the desired ground roll point on Isobar D', as indicated by Point F, the club length and static clubhead loft that will produce the target ground roll can be determined while holding all other design parameters constant and maintaining the desired carry distance. As such, to decrease the ground roll of the 3-iron of the conventional set to the target ground roll, the static clubhead loft is increased to nearly 26 degrees and the club length is increased to about 41 inches.

Figure 6:
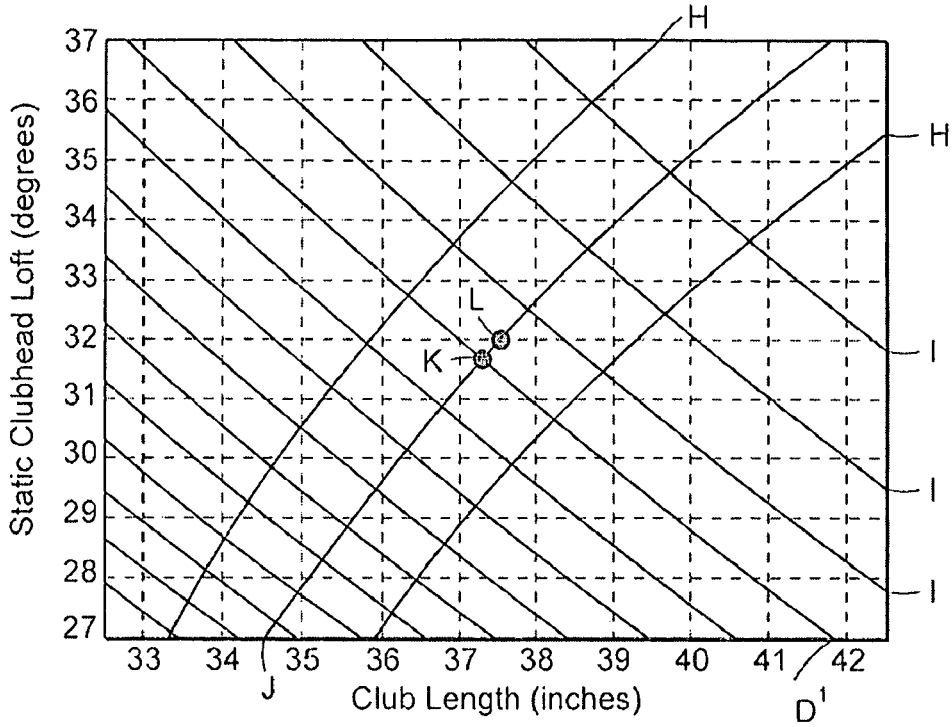
FIG. 6 is a graph showing the variation in ground roll and carry distance versus club length and static club loft for 6-irons.

FIG. 6 is similar to FIG. 5 in that it shows how simultaneous changes in static clubhead loft and club length simultaneously affect ground roll and carry distance, assuming an average PGA Tour player swing. However, FIG. 6 shows these changes for a 6-iron of the conventional set. Isobars I show ground roll differentials of ½ yard, with Isobar D' showing the target ground roll point. Isobars H show carry distance differentials of 15 yards. Isobar J reflects the carry distance of the 6-iron of the conventional set. Point L on FIG. 6 indicates the carry distance and ground roll of the 6-iron of the conventional set, a 37.5 inch club with a static clubhead loft of 32 degrees. By following Isobar J to the desired ground roll point on Isobar D', as indicated by Point K, the club length and static clubhead loft that will produce the target ground roll can be determined while holding all other design parameters constant and maintaining the desired carry distance. As such, to increase the ground roll of the 6-iron of the conventional set to the target ground roll, the static clubhead loft is decreased to about 31.7 degrees and the club length is decreased to about 37.3 inches. Notably, the adjustments to the club length and static clubhead loft for the 6-iron are relatively minor as compared with the changes made to the 3-iron in order to obtain the same ground roll for both clubs, as the desired ground roll is closer to the ground roll of the conventional 6-iron than the conventional 3-iron. As such, it would be appropriate to use the conventional 6-iron as the 6-iron of the inventive set, to avoid re-tooling or redesigning the club while still having approximately the same amount of ground roll as the rest of the set.

Figure 7:
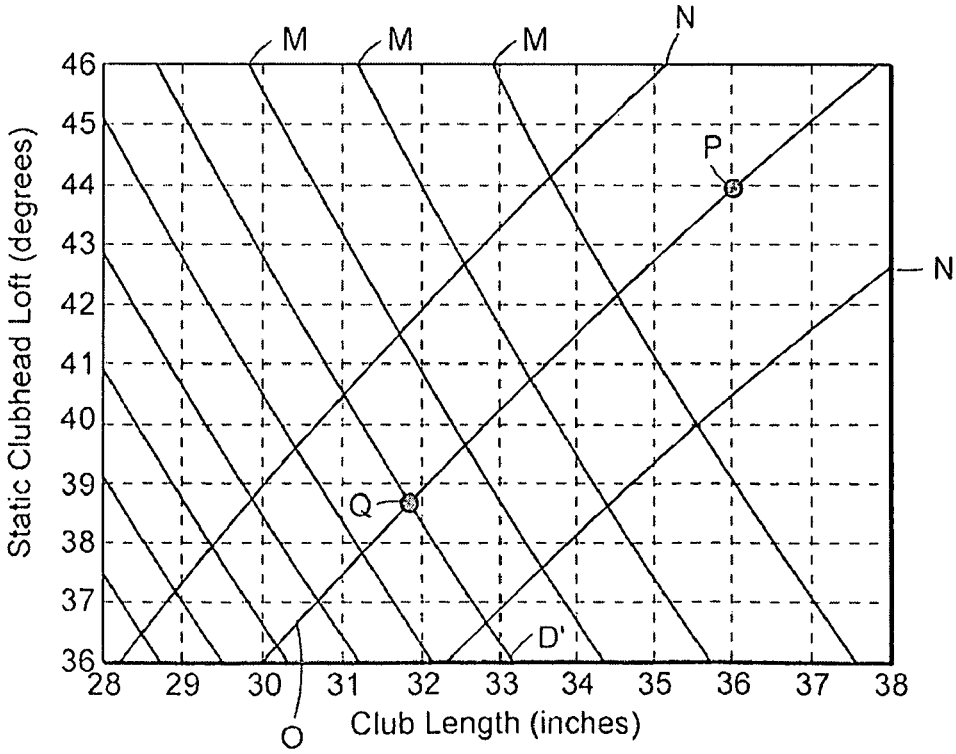
FIG. 7 is a graph showing the variation in ground roll and carry distance versus club length and static club loft for 9-irons.

FIG. 7 is similar to FIGS. 5 and 6 in that it shows how changes in static clubhead loft and club length simultaneously affect ground roll and carry distance, but for a 9-iron, assuming an average PGA Tour player swing. Isobars M show ground roll differentials of ½ yard, increasing in distance with decreasing club length, with Isobar D' indicating the desired ground roll for the inventive set. Isobars N show carry distance differentials of 20 yards, generally increasing with increasing club length. Isobar O reflects the carry distance of the 9-iron of the conventional set. Point P on FIG. 7 indicates the carry distance and ground roll of the 9-iron of the conventional set, a 36-inch club with a static clubhead loft of 44 degrees. By following Isobar O to the desired ground roll point, as indicated by Point Q on Isobar D', the club length and static clubhead loft that will produce the target ground roll can be determined while holding all other design characteristics constant and maintaining the desired carry distance. As such, to increase the ground roll of the 9-iron of the conventional set to the desired level reflected by Isobar D', the static clubhead loft is decreased to about 38 degrees and the club length is decreased to about 32 inches. As this point remains on Isobar O, the carry distance remains the same for the inventive 9-iron as the conventional 9-iron. As will be recognized by those in the art, the club length for the 9-iron may be shorter than is comfortably played for many players. Therefore, it is within the scope of the invention to lengthen the 9-iron, such as to a more comfortable 34.125 inches. As the target ground roll need only be within one yard of the ground roll identified by Isobar D', a static loft of about 42 degrees may be selected to achieve a ground roll within tolerances.

Figure 8:
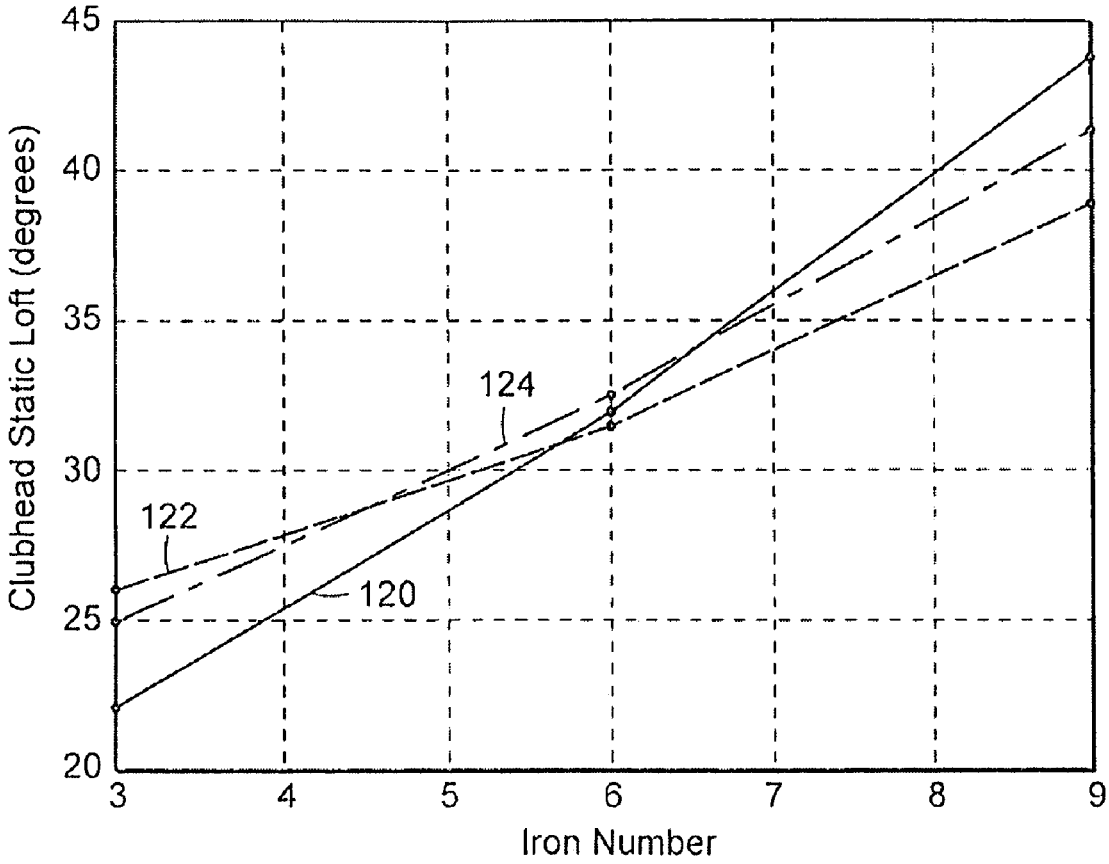
FIG. 8 is a graph showing the variation in clubhead static loft versus iron number for three sets of iron-type golf clubs, one conventional set and two constant roll sets.
Figure 9:
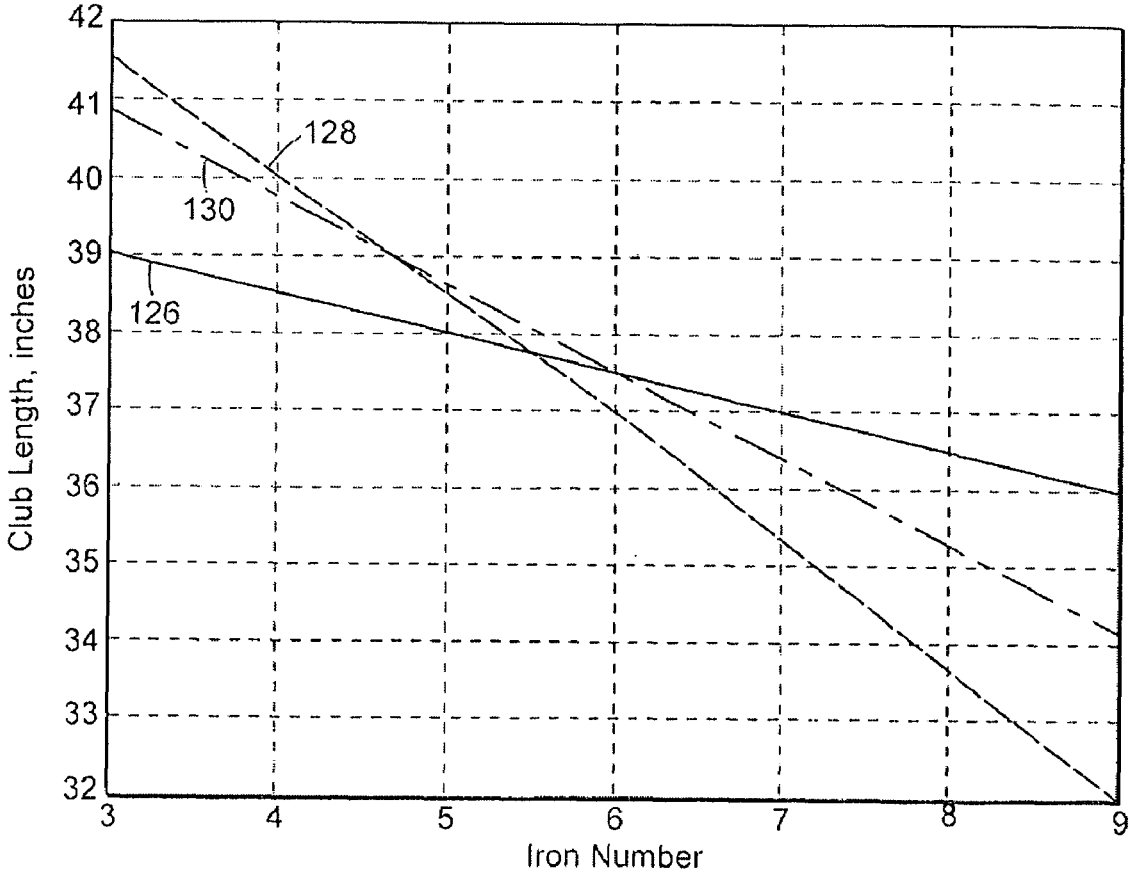
FIG. 9 is a graph showing the variation in club length versus iron number for three sets of iron-type golf clubs, one conventional set and two constant roll sets.
Figure 10:
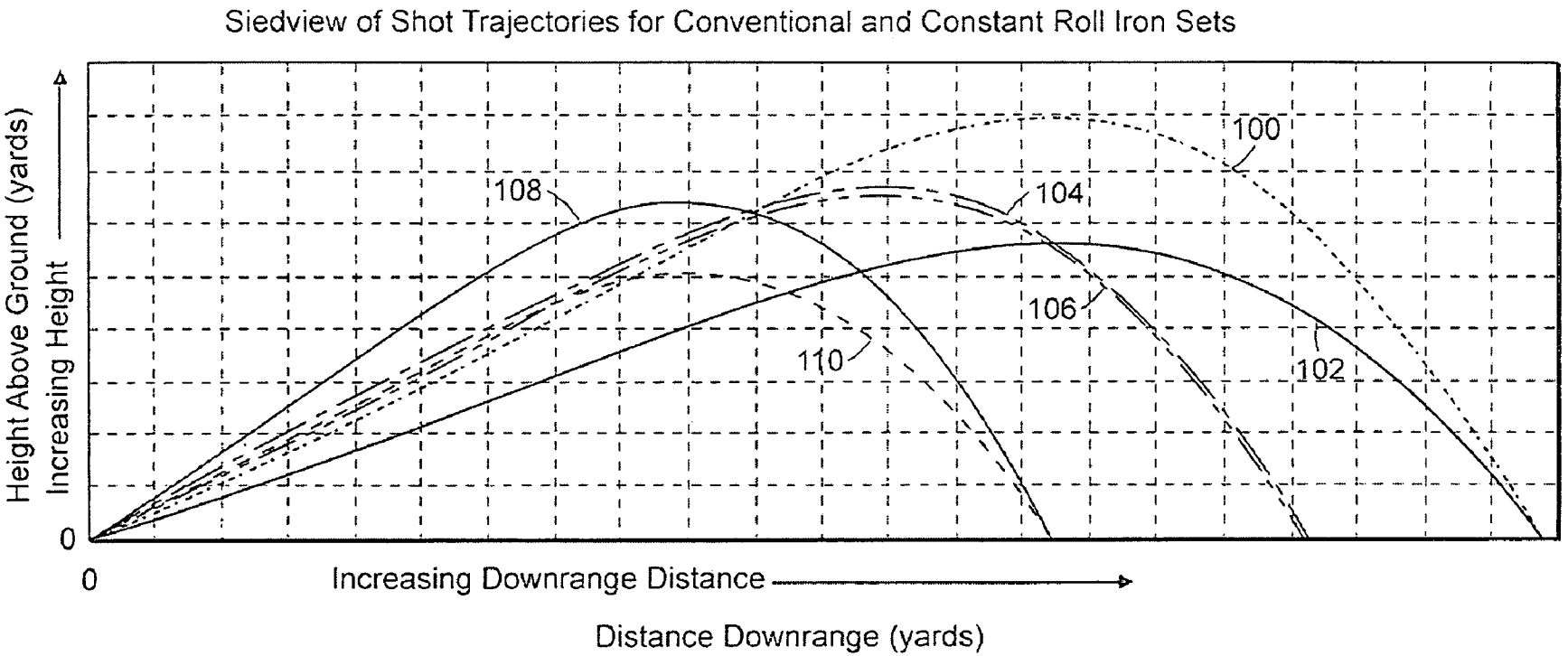
FIG. 10 is a graph showing the variations in flight trajectories for conventional and constant roll 3-, 6-, and 9-irons.

While only 3-, 6-, and 9-irons are discussed above, similar analysis and design can be done for each club in a set to achieve constant or nearly constant ground roll for each club in the set. FIGS. 8 and 9 show the selected static lofts (FIG. 8)

and club lengths (FIG. 9) for the conventional, ideal constant roll and nearly constant roll sets. In FIG. 8, curve 120 indicates the static lofts of the conventional set. Curve 122 indicates the static lofts of an inventive set that perfectly follows the graphs discussed above, while curve 124 indicates the static lofts of a preferred set which accounts for both nearly constant ground roll within the desired tolerances and other aesthetic considerations, such as a longer 9-iron than would be found in a set that strictly follows the determinations of the performance curves, as discussed above. In FIG. 9, curve 126 shows the club lengths for the clubs of the conventional set, while curve 128 shows the club lengths for the constant roll set. Curve 130 shows the preferred club lengths for the nearly constant roll set. As shown in FIG. 9, the club lengths of the nearly constant roll set more closely resemble those of the conventional set than do the clubs of the constant roll set.

As such, the desired carry distances for the inventive 3-, 6-, and 9-irons remain the same as those of the conventional 3-, 6-, and 9-irons, respectively, while each club in the inventive set produces the same or nearly the same ground roll. This added level of predictability is reflected in FIG. 8, which shows the trajectories achieved by the inventive and conventional sets. The trajectory of the conventional 3-iron is indicated by line 100, with the inventive (constant roll) 3-iron trajectory indicated by trajectory 102. Both 3-irons, as struck by an average PGA Tour player, achieve the same downrange distance, with the conventional 3-iron having a higher maximum height above ground. Trajectory 104 indicates the trajectory of the conventional 6-iron, and trajectory 106 indicates the trajectory of the inventive 6-iron. As with the 3-irons, the same downrange distance is achieved with both 6-irons, with the conventional 6-iron having a slightly higher maximum height above ground than the inventive 6-iron. However, as discussed above, the conventional 6-iron produces a ground roll very similar to the target ground roll, so the conventional 6-iron may be used in the inventive set, in which case trajectories 104 and 106 would be exactly the same. Finally, trajectory 108 indicates the trajectory of the conventional 9-iron, and trajectory 110 indicates the trajectory of the inventive 9-iron. As with the irons discussed above, the same downrange distance is achieved with both 9-irons, with the conventional 9-iron having a slightly higher maximum height above ground than the inventive 9-iron.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with feature(s) and/or element(s) from other embodiment(s). Therefore, it will be understood that the appended claims are intended to cover all such modifications and embodiments, which would come within the spirit and scope of the present invention. All publications discussed herein, including but not limited to patents, patent applications, articles, and books, are incorporated by reference in their entireties.

The invention claimed is:

1. A method for producing a set of golf clubs with constant ground roll comprising the steps of:

(i) selecting a target ground roll;

(ii) selecting a club;

(iii) obtaining a ground roll performance curve for the club and at least one other performance curve using the club;

(iv) adjusting at least two design characteristics of the club to achieve the target ground roll while maintaining the at least one other performance curve; and (v) producing said club with said target ground roll.

2. The method of claim 1 further comprising the step of (vi) obtaining player swing information using the club for use in developing the performance curves in step (iii).

3. The method of claim 2, wherein step (vi) comprises collecting swing data from multiple players and determining average swing characteristics therefrom.

4. The method of claim 2, wherein step (vi) comprises collecting swing data from an individual player.

5. The method of claim 1, wherein the at least one other performance curve comprises a carry distance performance curve.

6. The method of claim 1, wherein the at least two design characteristics are selected from the group consisting of a static loft angle, a club length, a location of a clubhead center of gravity, a shaft flexibility, and a groove volume.

7. The method of claim 6, wherein the at least two design characteristics are the static loft angle and the club length.

8. The method of claim 7, wherein the static clubhead loft and the club length provide coarse adjustments while any of the location of a clubhead center of gravity, the shaft flexibility, and the groove volume are used to fine-tune the ground roll distance.

9. The method of claim 1 further comprising the step of repeating steps (ii) through (v) for at least one additional club.

10. The method of claim 9, wherein steps (ii) through (v) are repeated for each iron-type club in the set.

11. The method of claim 1, wherein the club is an iron-type club.

12. The method of claim 11, wherein the club is a muscle-back club.

13. A method for producing a set of golf clubs with constant ground roll comprising the steps of:

(i) selecting a target ground roll;

(ii) selecting a club;

(iii) obtaining a ground roll performance curve for the club and at least a carry distance curve using the club;

(iv) adjusting at least a static loft angle and a club length of the club to achieve the target ground roll while maintaining the carry distance curve; and (v) producing said club with said target ground roll.

14. The method of claim 13 further comprising the step of (vi) obtaining player swing information using the club for use in developing the performance curves in step (iii).

15. The method of claim 14, wherein step (vi) comprises collecting swing data from multiple players and determining average swing characteristics therefrom.

16. The method of claim 14, wherein step (vi) comprises collecting swing data from an individual player.

17. The method of claim 13, wherein the static clubhead loft and the club length provide coarse adjustments while any of the location of a clubhead center of gravity, the shaft flexibility, and the groove volume are used to fine-tune the ground roll distance.

18. The method of claim 13 further comprising the step of repeating steps (ii) through (v) for at least one additional club.

19. The method of claim 18, wherein steps (ii) through (v) are repeated for each iron-type club in the set.

20. The method of claim 13, wherein the club is an iron-type club.

* * * * *